US006241124B1

(12) United States Patent
Hoyt

(10) Patent No.: US 6,241,124 B1
(45) Date of Patent: Jun. 5, 2001

(54) SINGLE-USE CONTAINER

(75) Inventor: Earl Hoyt, Woodstock, NY (US)

(73) Assignee: Bausch & Lomb Incorporated, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/999,543

(22) Filed: Nov. 25, 1997

Related U.S. Application Data

(60) Provisional application No. 60/032,632, filed on Dec. 9, 1996.

(51) Int. Cl.[7] ..... B67D 5/60

(52) U.S. Cl. ..... 222/143; 222/153.06; 222/210; 222/215; 222/420

(58) Field of Search ..... 222/153.06, 206, 222/210, 212, 215, 420, 541.6, 129, 143

(56) References Cited

U.S. PATENT DOCUMENTS

| | | | | |
|---|---|---|---|---|
| 3,930,500 | | 1/1976 | Möhrke et al. | 128/233 |
| 3,991,758 | | 11/1976 | Möhrke et al. | 128/233 |
| 3,993,223 | | 11/1976 | Welker, III et al. | 222/107 |
| 4,022,206 | | 5/1977 | Hilleman et al. | 128/216 |
| 4,408,699 | * | 10/1983 | Stock | 222/420 |
| 5,040,706 | * | 8/1991 | Davis et al. | 222/420 |
| 5,409,125 | * | 4/1995 | Kimber et al. | 222/541.6 |
| 5,649,648 | * | 7/1997 | Lier et al. | 222/206 |

FOREIGN PATENT DOCUMENTS

| | | | | |
|---|---|---|---|---|
| 0276198 | * | 7/1988 | (EP) | 222/215 |
| 0350772 | | 1/1990 | (EP) . | |
| 0743057 | | 11/1996 | (EP) . | |
| 1074325 | | 10/1954 | (FR) . | |
| 2104882 | | 4/1972 | (FR) . | |
| 832056 | | 5/1960 | (GB) . | |
| 9405556 | * | 3/1994 | (WO) | 222/206 |

* cited by examiner

*Primary Examiner*—Joseph A. Kaufman
(74) *Attorney, Agent, or Firm*—Robert B. Furr, Jr.

(57) ABSTRACT

The present invention is a single-use container useful for the storage and dispension of small quantities of liquids. The subject container is particularly useful for dispensing sterile, preservative-free formulations, such as those used in single dose eye drop applications.

4 Claims, 4 Drawing Sheets

FIG. 1
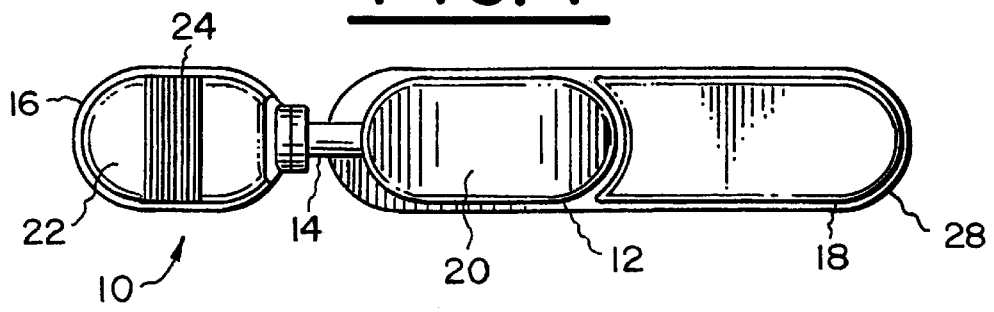
FIG. 2
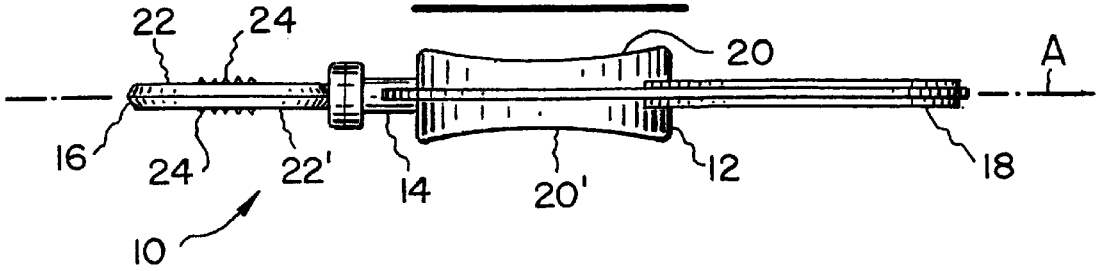
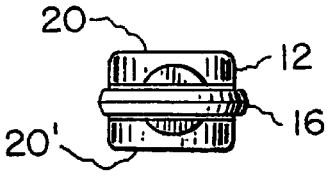
FIG. 3
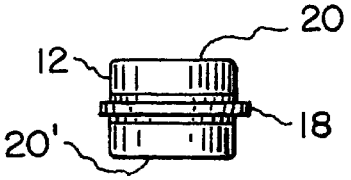
FIG. 4

FIG. 5
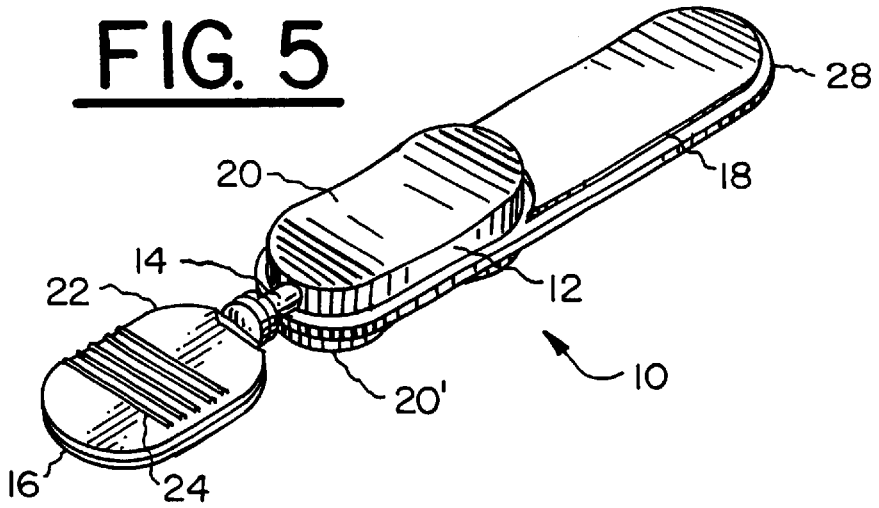
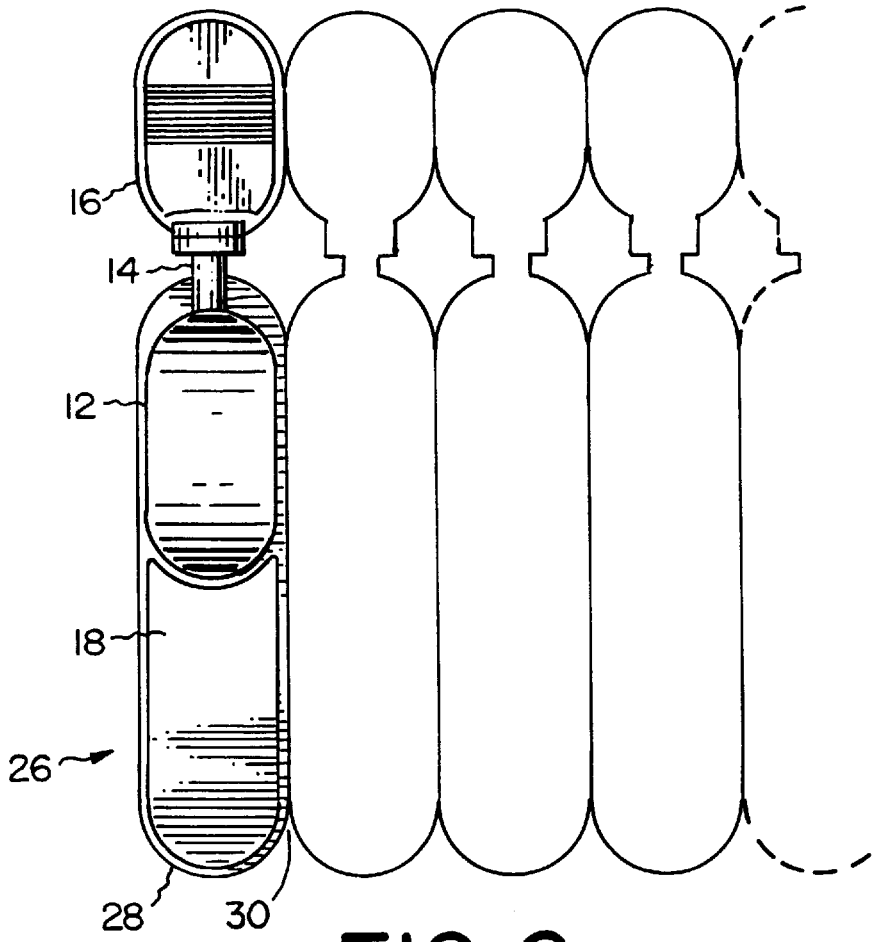
FIG. 6

SINGLE-USE CONTAINER

This application claims the benefit of U.S. Provisional Application No.: 60/032,632 filed on Dec. 9, 1996.

FIELD OF THE INVENTION

The present invention is a single-use container useful for storage and dispension of small quantities of liquids. The subject container is particularly useful for dispensing sterile, preservative-free formulations, such as those used in single dose eye drop applications.

BACKGROUND

Single-use containers are commonly used for providing small quantities of sterile, preservative-free liquids, e.g. lubricating eye drops. Commercial examples of such containers are used in the following products: Dry Eye Therapy® Lubricating Eye Drops from Bausch & Lomb; Tears Naturale Free® and Bion® Tears Lubricating Eye Drops from Alcon; Celluvisc® and Refresh PlusTM Lubricating Eye Drops from Allergan; OcuCoat™PF Lubricating Eye Drops from Storz Opththalmics; and Hypo Tears® PF Lubricating Eye Drops from IOLAB.

Such containers are typically molded from low density polyethylene using form-fill seal or blow-fill seal technology. The containers include: a vessel portion for containing a small quantity of liquid, (e.g. typically from 0.1 to 3.0 ml), a twist-off seal top for sealing liquid within the vessel, and a neck portion interconnecting the seal top and vessel. To dispense liquid from the container, the seal top is bent, twisted or otherwise broken from the neck. The vessel is then squeezed between the finger tips to force liquid from the vessel and through the neck portion where droplets are formed. Once the liquid has been dispensed, the container is discarded.

A significant drawback to current single-use containers is they are not adapted for engagement between the finger tips, (e.g. between the forefinger finger tip and the finger tip of the thumb or other finger). That is, the outer surface of the vessel is egg-shaped, cylindrical, or wedge-shaped. As a consequence, when squeezing the vessel of current containers, the vessel tends to slip away from the opposing pressure of the finger tips. This problem is compounded with containers employing thicker vessel walls which are not easily deformed by squeezing. This situation is further compounded for persons suffering with arthritis or those otherwise having compromised hand and finger strength.

Another problem with current containers is the difficulty of removing the seal top. In order to avoid seal breakage during shipping and storage, the wall thickness of containers can be significant, thus making the seal tops difficult to remove. This problem is compounded by the small size of the seal top and its relatively smooth surface.

It is desired to provide a single-use container which provides greater ease of dispension. It is further desired to provide such a container which is more easily opened.

SUMMARY OF THE INVENTION

The present invention provides a single-use container including: a vessel for holding liquid wherein the vessel includes two opposing engagement surfaces, a removable seal top for sealing the vessel, and a neck portion interconnecting the vessel and the seal top. In order to provide greater ease of dispension, the engagement surfaces of the vessel are specifically adapted for engagement between the finger tips. More specifically, the engagement surfaces of the vessel are concave, (along the longitudinal axis of the container), thus trapping the vessel between the finger tips as the vessel is squeezed.

The seal top of the subject container is also provided with two opposing engagement surfaces. In order to provide a container which is easier to open, at least one, and preferably both engagement surfaces of the seal top are provided with a plurality of ridges, thus providing a surface which is easier to grip between the finger tips.

BRIEF DESCRIPTION OF THE DRAWINGS

FIG. 1 is a top view of the subject single-use container;

FIG. 2 is a side view of the subject single-use container;

FIG. 3 is a front view of the subject single-use container;

FIG. 4 is a rear view of the subject single-use container;

FIG. 5 is a perspective view of the subject single-use container;

FIG. 6 is a top view showing several container attached laterally forming a strip;

DETAILED DESCRIPTION OF THE INVENTION

As indicated above, the present invention is a single-use container useful for storing and dispensing small quantities of liquids. Although the subject container is particularly useful for dispensing sterile, preservative-free formulations, such as those used in single dose eye drop applications, the subject container may also be used with other liquids, e.g. dyes, adhesive, medicines such as those administered orally, ear drops, nasal drops, and the like. The subject container is particularly well suited for providing introductory or promotional sample size quantities of liquids.

Figure 7:
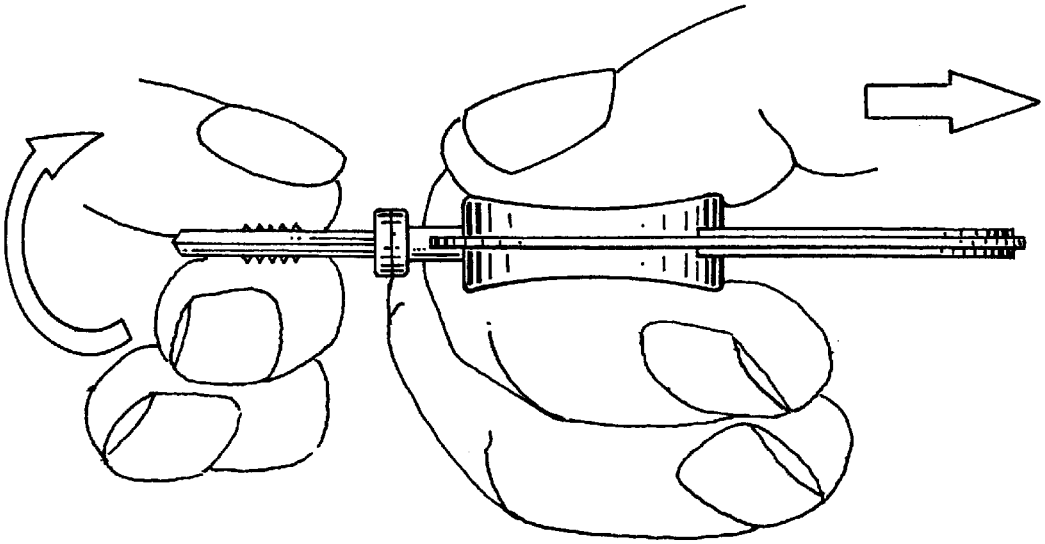
FIG. 7 is a side view showing the container being opened.
Figure 8:
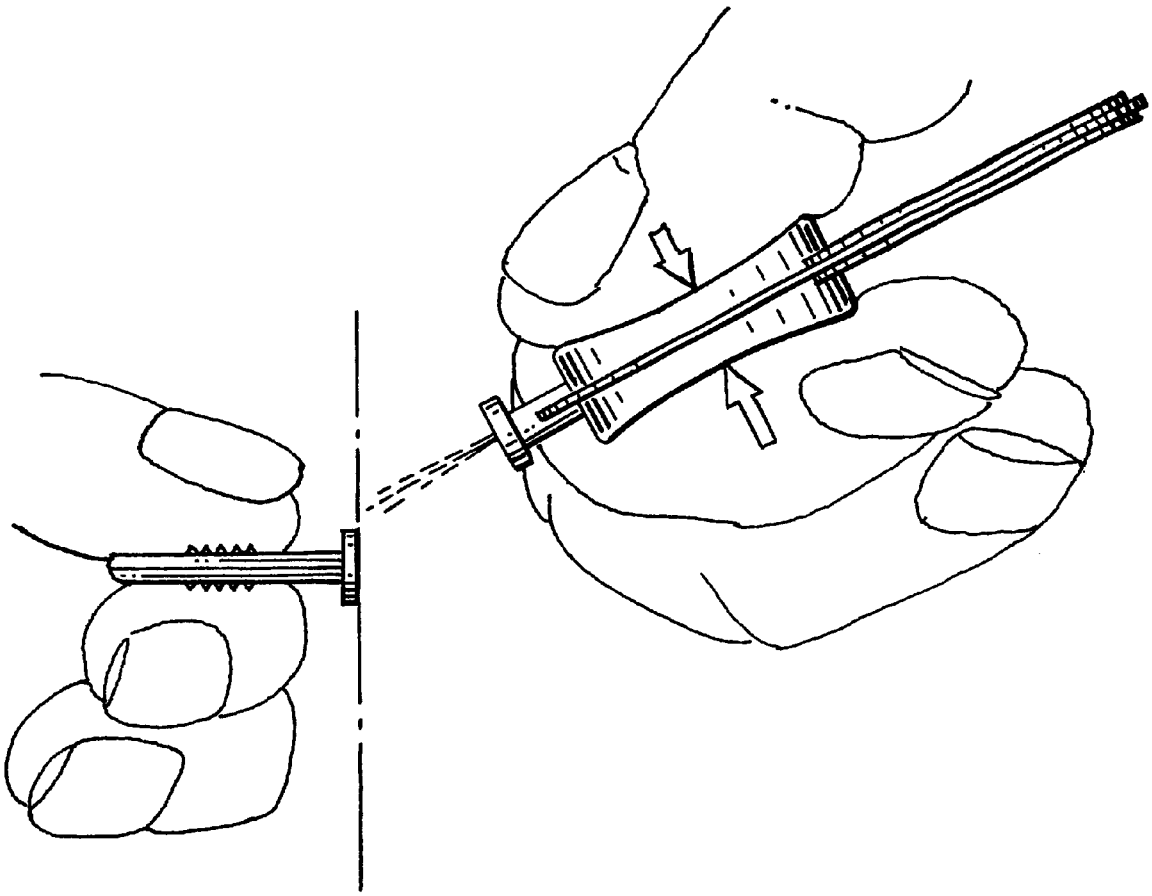
FIG. 8 is a side view showing the container opened and liquid being dispensed therefrom.

With reference to the Figures, the subject container is generally shown at 10, including a vessel 12, neck 14, seal top 16, and tab 18. With most applications, the vessel 12 is designed to hold small quantities of liquid, i.e. typically from about 0.1 to 3 milliliters; however, vessels for accommodating larger quantities of liquid may be used. The vessel 12 includes two opposing engagement surfaces 20, 20' which are designed to accommodate the surface of one's fingers tips, thus making the container easier to hold and squeeze. As best shown in FIGS. 2, 7, and 8, the engagement surfaces 20, 20' have concave surface (provided along the longitudinal axis A of container) which corresponds to the rounded surface of the finger tips. Consequently, the vessel 12 is self-centering between ones finger tips while being squeezed therebetween, rather than sliding away as with outwardly rounded, egg-shaped, cylindrical, or wedge-shaped vessels.

The seal top 16 is relatively flat and includes two opposing engagement surfaces 22, 22' which are designed to be grasped between the finger tips. During removal, the seal top 16 is bent, twisted, and removed from the neck 14. This process is best shown in FIG. 7. In order to provide for greater ease of removal, at least one and preferably both engagement surfaces 22 ,22' are provided with a plurality of ridges or ribs 24. These ribs 24 permit the engagement surface(s) 22, 22' to be easier grasped, (i.e. the engagement surface is less smooth), thus permitting the seal top 16 to be more easily removed. Similarly, although not shown, such ribs may be used on the engagement surfaces 20, 20' of the vessel 12.

As previously indicated, the container 10 may further include a flat tab portion 18 extending longitudinally from the vessel 12, opposite the seal top 16. As shown in FIG. 6, multiple containers 10 may be connected laterally by attaching the tabs 18 of each container 10 to form a strip, generally shown at 26. This is usually accomplished during manufacturing wherein several containers 10 are made simultaneously, in lateral arrangement, as indicated in FIG. 6. With respect to eye drop applications, strips 26 including four or five containers 10 are packaged. When needed, a single container 10 is removed from the strip 26 by grasping the tab 18 and tearing the intended container 10 from the strip 26.

Unlike prior art containers which include sharp corners at the end of the tab, the subject container 10 includes a tab 18 having a rounded corner, shown at 28. Thus, the subject container is less likely to catch on articles and may be easily stored in pockets of clothing. Furthermore, the subject rounded end 28 of the tab 18 provides an area, best shown as 30 in FIG. 6, which is not attached to adjacent containers during form-fill manufacturing. This area 30 provides a self-starting location for easing the removal of individual containers 10 from the strip 26.

Many modifications and variations of the instant invention are possible in light of the above teachings. It is therefor, to be understood that within the scope of the appended claims, the invention may be practiced otherwise than as specifically described.

What is claimed is:

1. A strip of single-use containers, said containers each comprising a vessel for holding liquid wherein the vessel comprises two opposing engagement surfaces, a removable seal top for sealing the vessel, and a neck portion interconnecting the vessel and the seal top, wherein the improvement comprises each engagement surface of the vessel having a concave surface along the longitudinal axis of the container which corresponds to the rounded surface of the finger tips so that the vessel is self-centering between one's finger tips while being squeezed therebetween, the seal top comprises two opposing engagement surfaces with a plurality of ridges provided on at least one of the engagement surfaces of the seal top and a flat tab portion having a rounded comer, said flat tab portion extending longitudinally from the vessel opposite the seal top, wherein said containers are connected laterally by attaching the flat tab portions of adjacent containers to form a connected strip, wherein the rounded comers of adjacent flat tab portions form a self-starting location for easing the removal of individual containers from the strip.

2. The strip of claim 1 comprising at least four individual containers.

3. The strip of claim 2 comprising at least five individual containers.

4. A single use container comprising a vessel for holding liquid wherein the vessel comprises two opposing engagement surfaces, a removable seal top for sealing the vessel, and a neck portion interconnecting the vessel and the seal top, wherein the improvement comprises each engagement surface of the vessel having a concave surface along the longitudinal axis of the container which corresponds to the rounded surface of the finger tips so that the vessel is self-centering between one's finger tips while being squeezed therebetween, the seal top comprises two opposing engagement surfaces with a plurality of ridges provided on at least one of the engagement surfaces of the seal top and a flat tab portion extending longitudinally from the vessel opposite the seal top, said flat tab portion having a rounded comer such that fastening multiple containers together by attaching the flat tab portions provides a strip of containers having a self-starting location for easing the removal of individual containers from the strip.

* * * * *